US007913621B2

(12) United States Patent
Miyoshi

(10) Patent No.: US 7,913,621 B2
(45) Date of Patent: Mar. 29, 2011

(54) PLATE FEEDING APPARATUS AND PLATE FEEDING METHOD

(75) Inventor: Hiroshi Miyoshi, Kyoto (JP)

(73) Assignee: Dainippon Screen MFG., Ltd., Kyoto (JP)

( * ) Notice: Subject to any disclaimer, the term of this patent is extended or adjusted under 35 U.S.C. 154(b) by 639 days.

(21) Appl. No.: 11/806,714

(22) Filed: Jun. 4, 2007

(65) Prior Publication Data

US 2007/0280815 A1 Dec. 6, 2007

(30) Foreign Application Priority Data

Jun. 5, 2006 (JP) ..... 2006-155591

(51) Int. Cl.
*B41F 27/12* (2006.01)

(52) U.S. Cl. ..... 101/477; 101/480; 414/797

(58) Field of Classification Search ..... 101/477, 101/479, 483, 415.1; 271/90–92, 105–107; 414/416.07, 752.1, 797
See application file for complete search history.

(56) References Cited

U.S. PATENT DOCUMENTS

| | | | | |
|---|---|---|---|---|
| 6,341,932 | B1 | 1/2002 | Otsuji | |
| 6,776,097 | B2 * | 8/2004 | Takeda | 101/477 |
| 6,904,844 | B2 * | 6/2005 | Koizumi et al. | 101/477 |
| 7,044,056 | B2 * | 5/2006 | Miyoshi | 101/477 |
| 7,621,218 | B2 * | 11/2009 | Tokimasa et al. | 101/477 |
| 2003/0231947 | A1 | 12/2003 | Miyoshi | |
| 2005/0217524 | A1 | 10/2005 | Miyoshi | |
| 2005/0242489 | A1 | 11/2005 | Taiji | |

FOREIGN PATENT DOCUMENTS

| | | |
|---|---|---|
| JP | 2000-247489 | 9/2000 |
| JP | 2000-351460 | 12/2000 |
| JP | 2004-018180 | 1/2004 |
| JP | 2005-289522 | 10/2005 |

OTHER PUBLICATIONS

European Search Report issued in Patent Application No. 07010709.9-1256 dated on Aug. 8, 2008.
Japanese Office Action issued in Japanese Patent Application No. JP 2006-155591 dated Sep. 14, 2010.

* cited by examiner

*Primary Examiner* — Ren Yan
(74) *Attorney, Agent, or Firm* — McDermott Will & Emery LLP

(57) ABSTRACT

A plate feeding method includes a suction-holding step for causing suction pads to suck and hold an upper surface adjacent an end edge, remote from nip rollers, of each plate, a moving step, while swinging the suction pads about a moving unit, for moving the moving unit toward the nip rollers, thereby inverting a portion adjacent the end edge of each plate P, and subsequently moving the end edge of the plate inverted to a position to be pinched by the nip rollers, a pinching step for causing the nip rollers to pinch the end edge of the plate having been inverted, a releasing step for canceling suction-holding of the plate by the suction pads, a pressing step for pressing the plate with a support roller, and a transporting step for rotating the nip rollers to transport the plate P.

6 Claims, 14 Drawing Sheets

PLATE FEEDING APPARATUS AND PLATE FEEDING METHOD

BACKGROUND OF THE INVENTION

1. Field of the Invention

This invention relates to a plate feeding apparatus for transporting stacked printing plates in order from an uppermost plate, and in an inverted state, to a plate takeout unit such as nip rollers.

2. Description of the Related Art

Japanese Unexamined Patent Publication No. 2000-247489, for example, discloses a plate feeding apparatus for transporting printing plates, in an inverted state, to a plate takeout unit. According to this apparatus, a suction point at a leading end of each plate sucked and held by suction pads is moved to coincide with a cycloid formed when a circle having a radius equal to the turning radius of the suction point rolls over the plate surface. Subsequently, the leading end of the plate is pinched by the plate takeout unit.

Such a plate feeding apparatus that transports printing plates, in an inverted state, to the plate takeout unit has an advantage of transporting the plates reliably without occupying a large floor space even when transporting relatively large plates.

In such a plate feeding apparatus, plates are usually stacked with end edges aligned by a stopper. Then, with the plate feeding apparatus that transports the plates, in an inverted state, to the plate takeout unit, when a distance from a plate storage unit to the plate takeout unit is small for the size of the plates, the rear end of a plate will thrust itself in between the end edges of the plates stacked and the stopper, making it impossible to transport the plate properly.

In order to solve this problem, it is conceivable to secure a sufficiently large distance from the plate storage unit to the plate takeout unit in accordance with the size of the plates. However, the increasingly large printing plates used nowadays will result in the entire apparatus occupying a large space.

SUMMARY OF THE INVENTION

The object of this invention, therefore, is to provide a plate feeding apparatus and a plate feeding method which can transport plates reliably without enlarging the apparatus.

The above object is fulfilled, according to this invention, by a plate feeding apparatus for transporting plates loaded therein, in order from an uppermost plate, while inverting the plates, toward a plate takeout unit that holds and takes out the plate, the apparatus comprising a storage unit for storing a plurality of plates with end edges aligned by a stopper; a moving unit movable along surfaces of the plates stored in the storage unit; a suction unit disposed at a distal end of an arm swingable about the moving unit for sucking and holding an upper surface adjacent an end edge, remote from the plate takeout unit, of each of the plates stored in the storage unit; a moving mechanism for moving the moving unit along the surfaces of the plates stored in the storage unit, from a position remote from the plate takeout unit toward the plate takeout unit, and for swinging the arm about the moving unit, thereby moving the suction unit to invert a portion adjacent the end edge of each plate sucked and held by the suction unit, and subsequently to reach a position for each plate to be held by the plate takeout unit; a pressing member for pressing an inner peripheral surface of a curved portion of each plate which has been curved while being inverted, to locate the curved portion further remote from the plate takeout unit than a vertical line extending from the stopper; and a pressing member moving device for moving the pressing member away from the plate takeout unit.

Such plate feeding apparatus can transport plates reliably without enlarging the apparatus.

In a preferred embodiment, the plate feeding apparatus includes a pressing member moving device. Thus, the pressing member can, in a selected position along the surfaces of the plates stored, press a portion of an inner peripheral surface of each plate curved as it is turned back. It is therefore possible to perform properly even when the position of the pressing member pressing plates is changed to handle plates of different sizes.

In a further aspect of the invention, a plate feeding method is provided for transporting plates stored in a storage unit with end edges of the plates aligned by a stopper, in order from an uppermost plate, while inverting the plates, to nip rollers, the method comprising a suction-holding step for causing a suction unit to suck and hold an upper surface adjacent an end edge, remote from the nip rollers, of each of the plates stored in the storage unit; a moving step, while swinging the suction unit about a moving unit, for moving the moving unit along the surfaces of the plates stored in the storage unit, from a position remote from the nip rollers toward the nip rollers, thereby inverting a portion adjacent the end edge of each plate sucked and held by the suction unit, and subsequently moving the end edge of each plate to a position to be pinched by the nip rollers; a pinching step for causing the nip rollers to pinch the end edge of each plate having been inverted; a releasing step for canceling suction-holding of each plate by the suction unit; and a pressing step for pressing each plate with a pressing member from adjacent the nip rollers to a position further remote from the nip rollers than the stopper.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
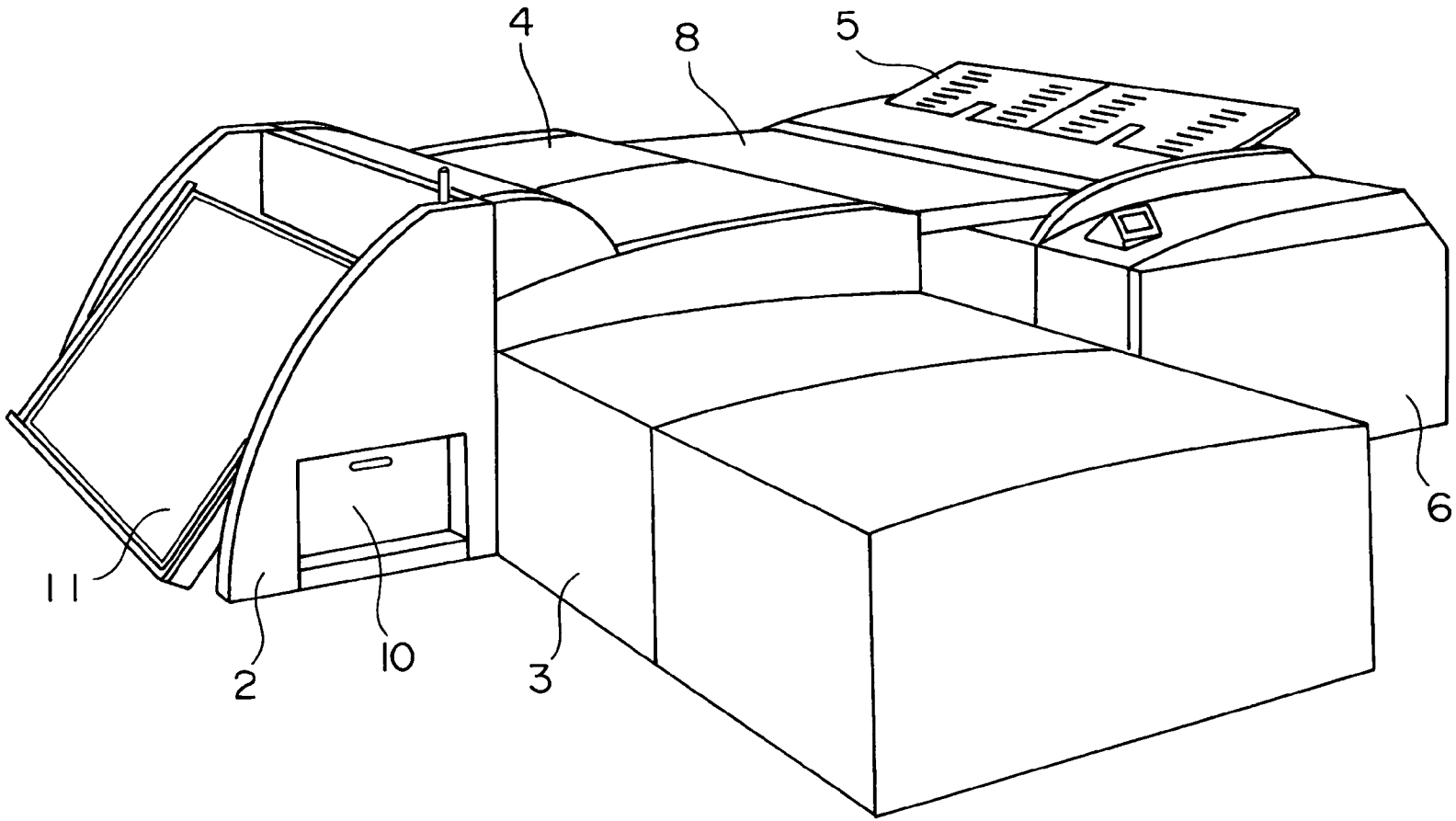
FIG. 1 is a perspective view of an image recording system having a plate feeding apparatus according to this invention.
Figure 2:
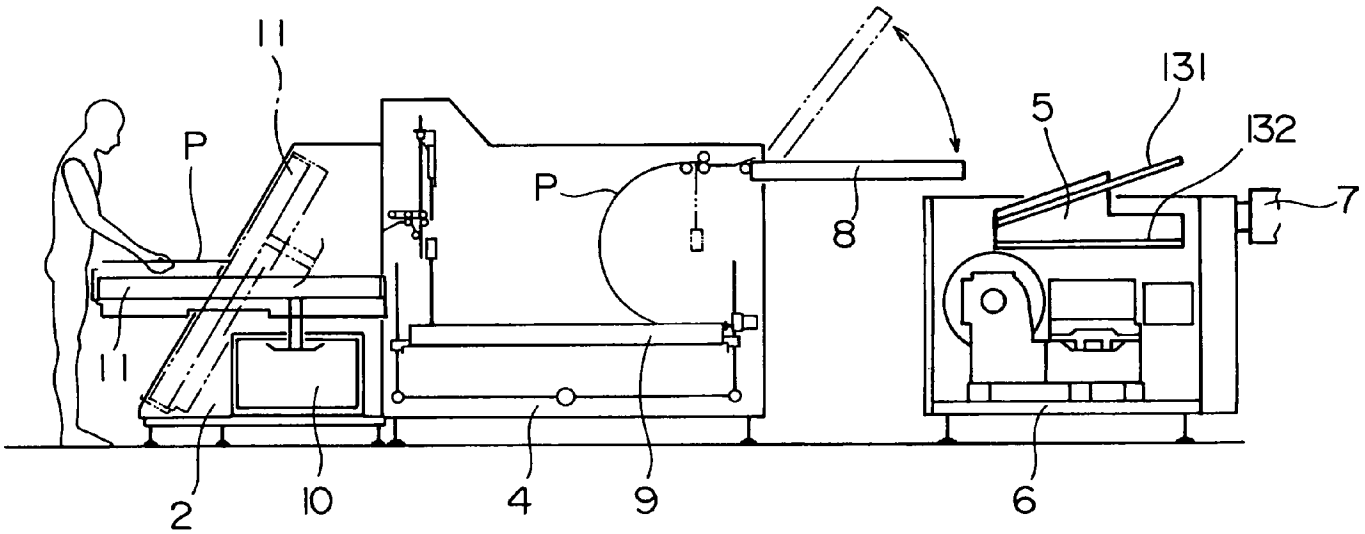
FIG. 2 is a schematic side view of the image recording system having the plate feeding apparatus according to this invention.

An embodiment of this invention will be described hereinafter with reference to the drawings. FIG. 1 is a perspective view of an image recording system having a plate feeding apparatus according to this invention. FIG. 2 is a schematic side view and FIG. 3 a schematic plan view of the system.

This image recording system includes a plate feed unit 2 for use in depositing plates P in each cassette 9 acting as a storage unit, a multi-cassette unit 3 having a plurality of cassettes 9 stacked one over the other, an auto-loader unit 4 for fetching and transporting plates P from a cassette 9 moved to a plate feed position, a plate loading and unloading tray unit 5 having a plate loading tray 131 and a plate unloading tray 132, a conveyor 8, an image recorder 6 for recording images on the plates P, and a transport mechanism 7 for transporting the plates P having images recorded thereon in the image recorder 6 to an auto developing device 10 disposed at a downstream stage.

The above conveyor 8 is provided to transport the plates P from the auto-loader unit 4 to the plate loading and unloading tray unit 5. In order to facilitate maintenance of the entire apparatus, the conveyor 8 is constructed pivotable upward about one end thereof as shown in two-dot chain lines in FIG. 2.

In this image recording system, the multi-cassette unit 3 accommodates a plurality of cassettes 9 stacked one over the other. When transporting plates P in a cassette 9 to the image recorder 6, a slide mechanism moves the cassette 9 from the multi-cassette unit 3 to the auto-loader unit 4. Then, a lift mechanism moves this cassette 9 vertically to the plate feed position shown in FIG. 2.

Figure 3:
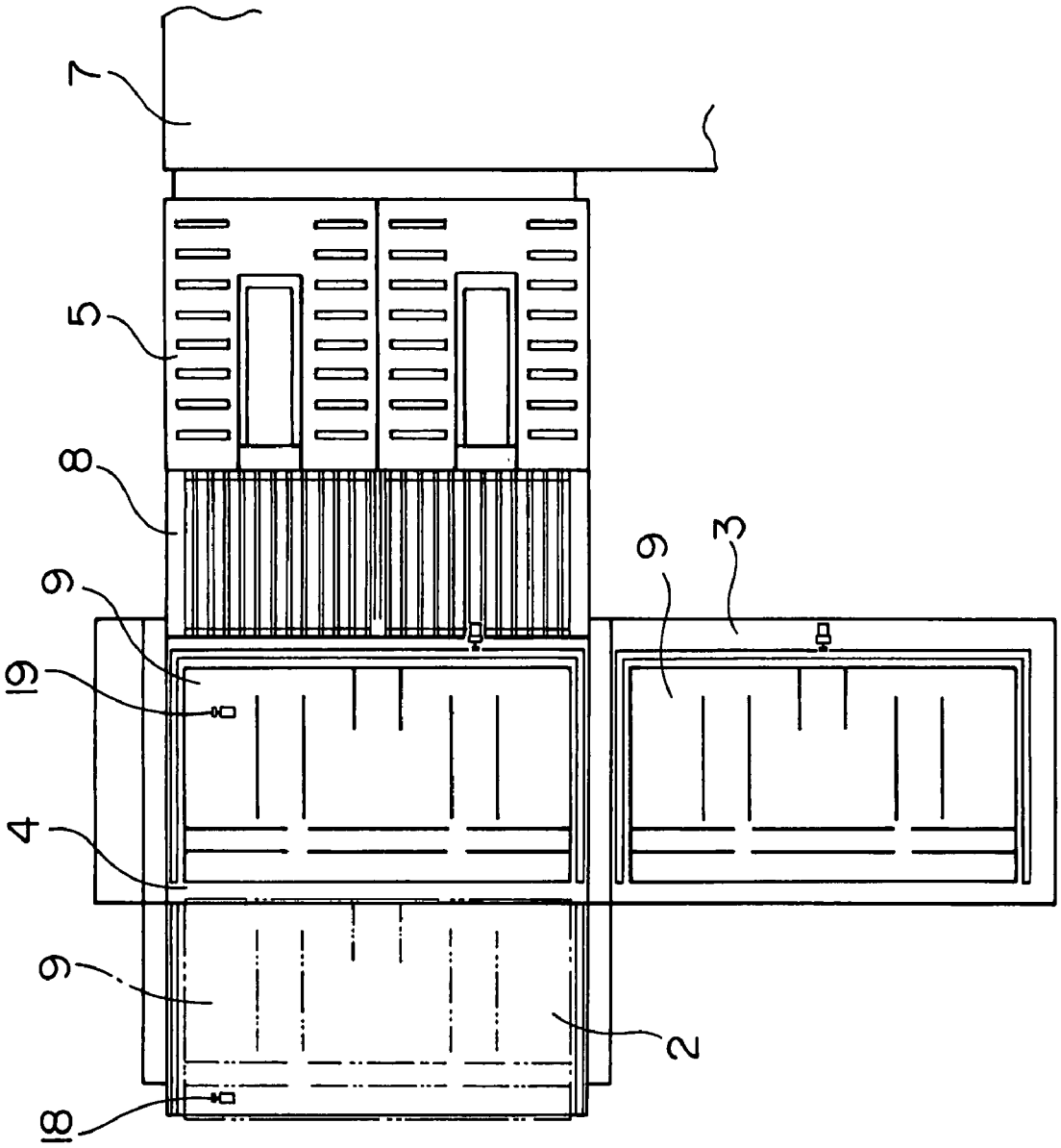
FIG. 3 is a schematic plan view of the image recording system having the plate feeding apparatus according to this invention.

When storing new plates P in a cassette 9, the cassette 9 is moved from the multi-cassette unit 3 to the auto-loader unit 4. Then, this cassette 9 is moved vertically to a cassette fetch position level in which it is aligned horizontally with a cassette holder 11 in a horizontal position shown in solid lines in FIG. 2. Subsequently, motors 18 and 19 shown in FIG. 3 are operated to move the cassette from the auto-loader unit 4 along guide members, not shown, into the cassette holder 11 in the cassette feed unit 2.

Figure 4:
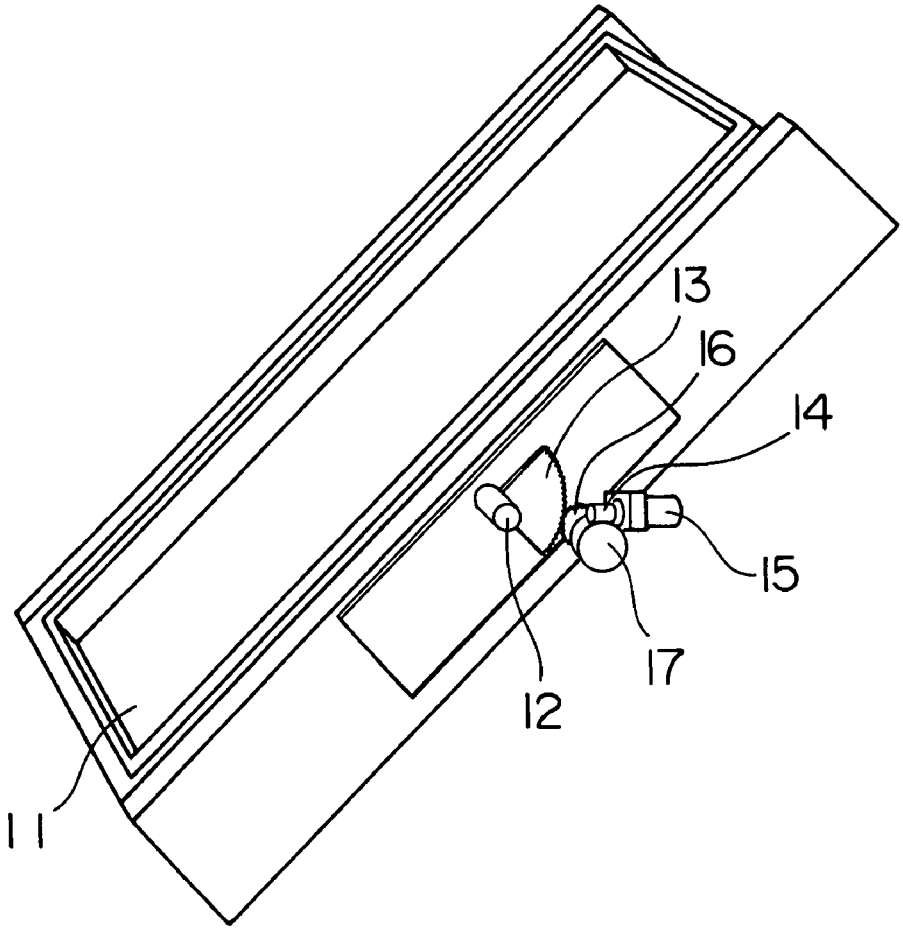
FIG. 4 is a perspective view of a cassette tray swing mechanism.

As shown in FIG. 4, this cassette holder 11 is disposed in the plate feed unit 2 to be pivotable about a shaft 12. The shaft 12 has a spur gear 13 formed peripherally of and coaxially with the shaft 12. On the other hand, the plate feed unit 2 has a motor 15 with a worm gear 14. The worm gear 14 is meshed with a worm wheel 17 coaxial with a spur gear 16 meshed with the spur gear 13. Consequently, the cassette holder 11 is constructed pivotable by the motor 15 between the horizontal position shown in solid lines in FIG. 2 and a tilted position shown in phantom lines in FIG. 2.

When moving a cassette 9 between the auto-loader unit 4 and cassette holder 11, the cassette holder 11 is set to the horizontal position. The cassette holder 11 may be horizontal also when storing relatively small plates P in a cassette 9 having moved into the cassette holder 11. However, when storing relatively large plates P in the cassette 9, the cassette holder 11 is set to the tilted position. Then the relatively large plates P can be stored in the cassette 9 easily without bending such plates P.

The auto-loader unit 4 which fetches and transports plates P from inside the above cassette 9 constitutes the plate feeding apparatus according to this invention. The construction of this auto-loader unit 4 will be described hereinafter.

Figure 5:
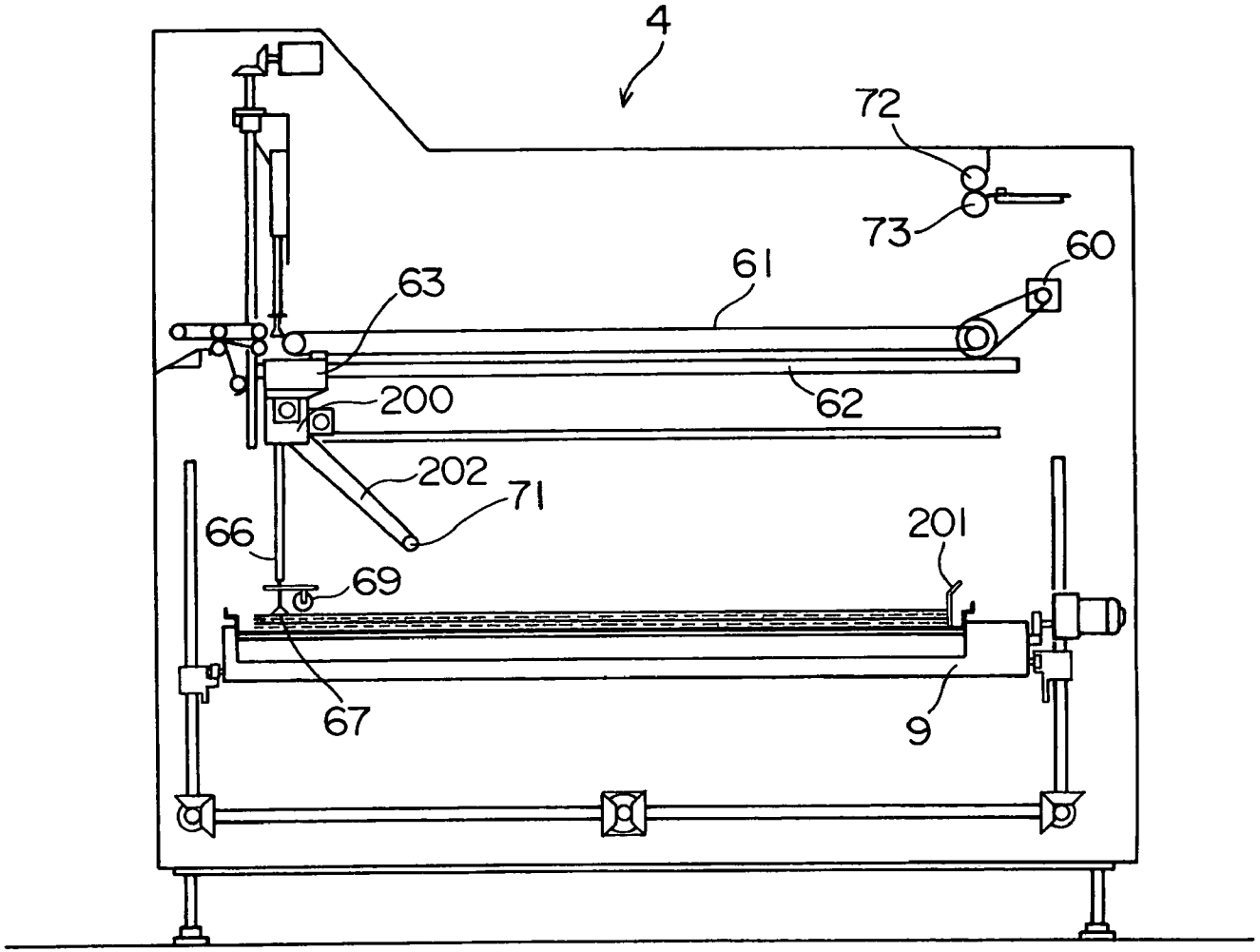
FIG. 5 is a schematic side view of an auto-loader unit.
Figure 6:
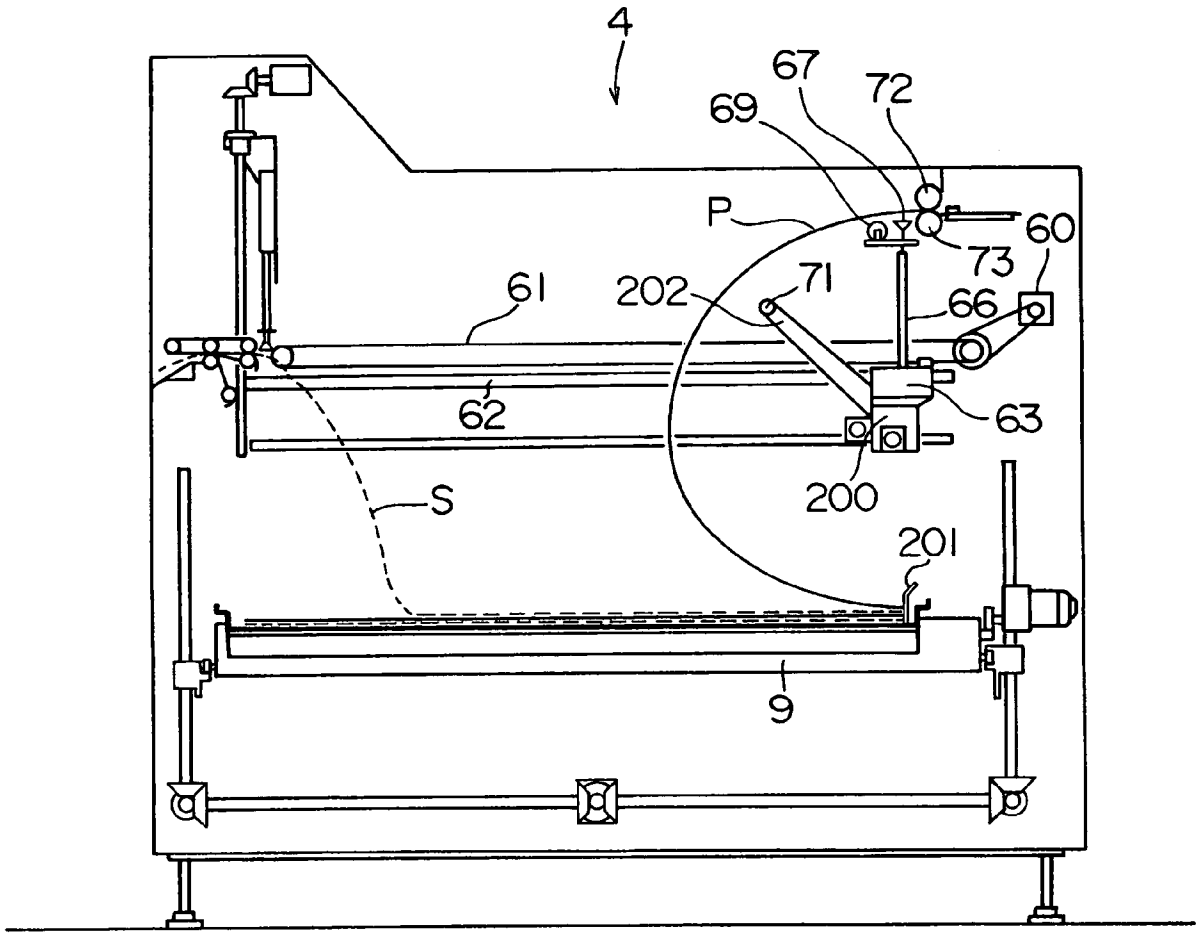
FIG. 6 is a schematic side view of the auto-loader unit.

FIGS. 5 and 6 are schematic side views of the auto-loader unit 4. FIG. 5 schematically shows a state before a plate transporting operation, and FIG. 6 a state after the plate transporting operation.

This auto-loader unit 4 includes a moving device 200 driven by an endless synchronous belt 61 rotatable by a motor 60, to run along a guide rail 62. The moving device 200 is engaged with the synchronous belt 61 through a mobile member 63. The moving device 200 has an arm 66 swingable relative thereto. The arm 66 has a plurality of suction pads 67 attached to a distal end thereof for sucking and holding a plate P. The arm 66 has a support roller 69 disposed at the distal end thereof for supporting the lower surface of a forward end region of the plate P when transporting the plate P. Further, the arm 66 is connected to an arm 202 having a support roller 71 disposed at a distal end thereof for supporting the lower surface of a central region of the plate P. The arm 66 is driven by a motor 205 described hereinafter, to swing with the arm 202 about the moving device 200.

In this auto-loader unit 4, as the moving device 200 is driven by the motor 60 to move rightward from the position shown in FIG. 5, the arm 66 swings about the moving device 200. Thus, when the moving device 200 is driven by the motor 60 to move rightward, with the suction pads 67 sucking and holding a plate P, the plate P held by the suction pads 67 is first turned back to become inverted as shown in FIG. 6. Subsequently, the resulting forward end of the plate P is pinched between a pair of nip rollers 72 and 73 for feeding the plate P toward the conveyor 8.

It should be noted that the auto-loader unit 4 has a guard paper discharge mechanism for discharging slip sheet S inserted between the plates P.

Figure 7:
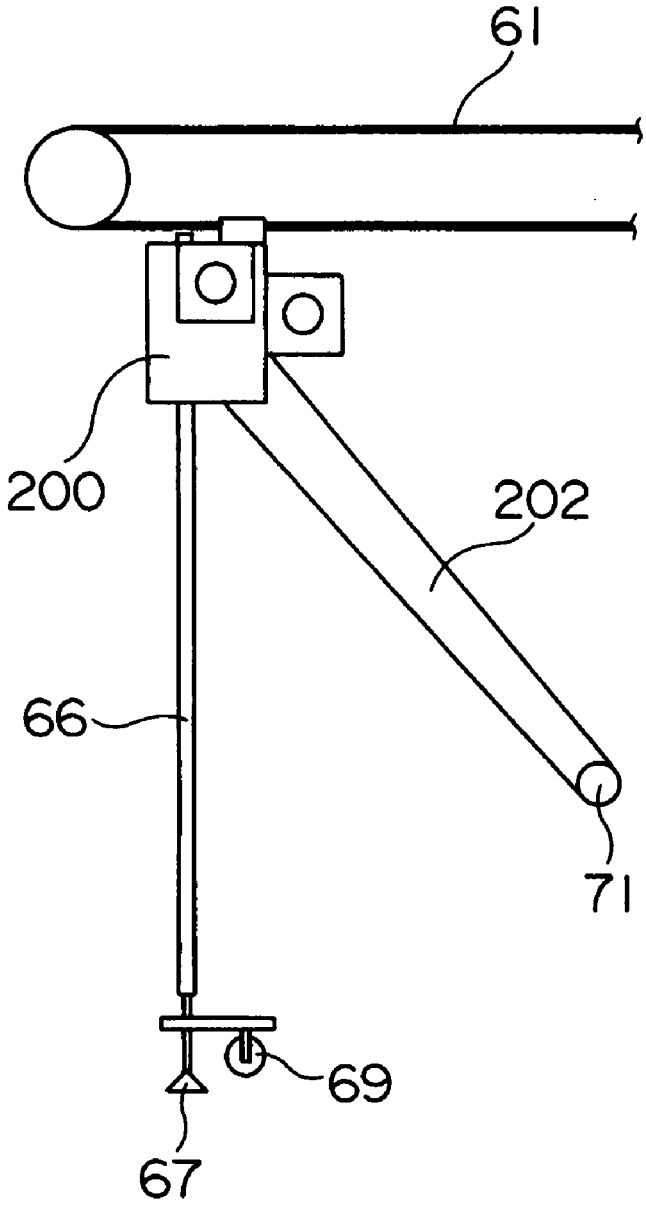
FIG. 7 is a schematic side view of a moving device and adjacent elements.
Figure 8:
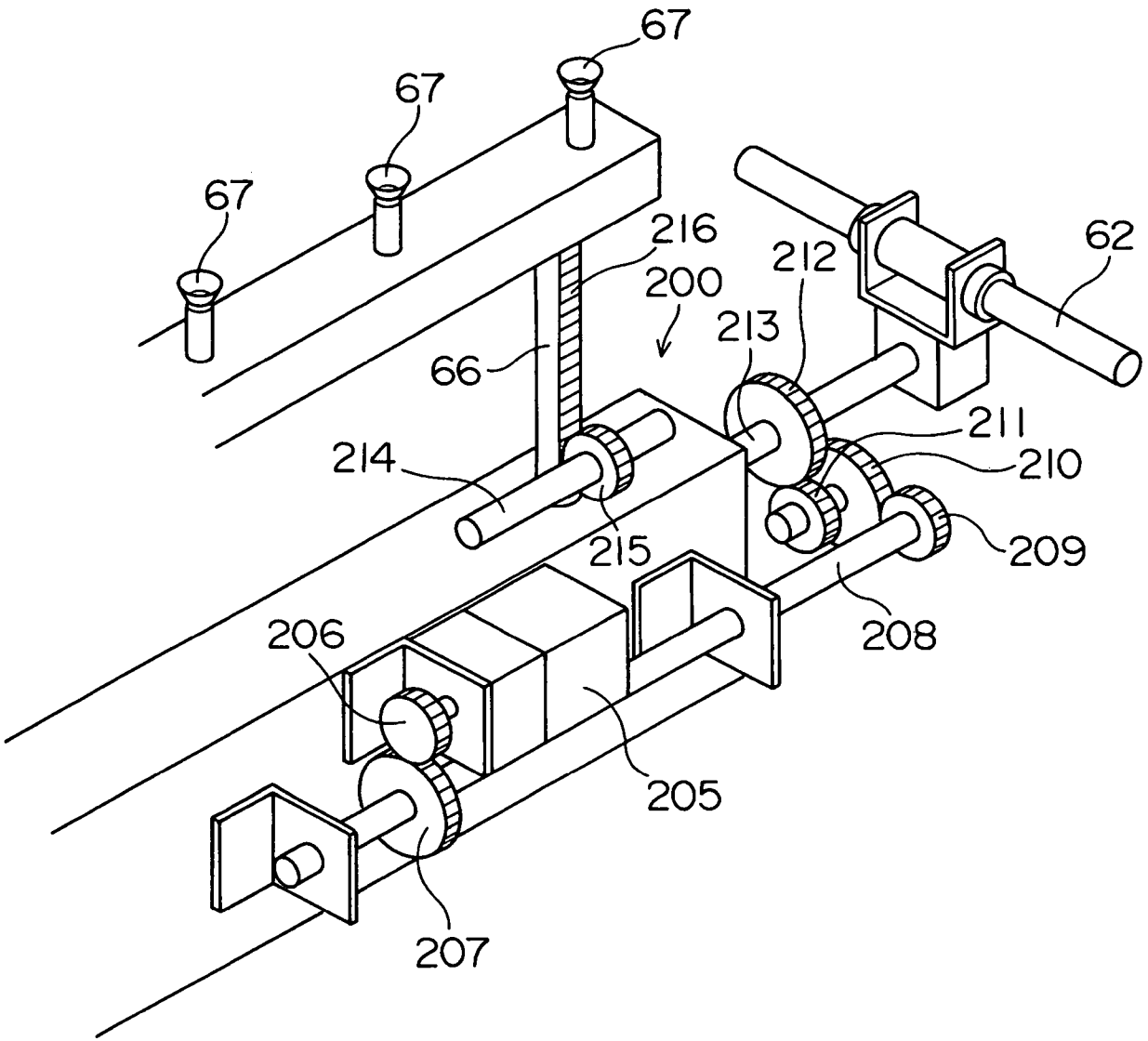
FIG. 8 is a perspective view showing a principal portion of the moving device and adjacent elements.

FIG. 7 is a schematic side view of the moving device 200 and adjacent elements. FIG. 8 is a perspective view showing a principal portion thereof. The mobile member 63 is omitted from FIG. 7.

The arm 66 noted above is connected to a shaft 213 (FIG. 8) included in the moving device 200, to be swingable about this shaft 213. The shaft 213 is connected to a shaft 208 through spur gears 212, 211, 210 and 209. The shaft 208 is connected to a drive shaft of the motor 205 through spur gears 207 and 206. Thus, the arm 66 is driven by the motor 205 to swing about the shaft 213.

Part of this arm 66 acts as a rack 216. The rack 216 is meshed with a spur gear 215 mounted on a shaft 214 rotatable by a motor not shown. The arm 66 has a length determined by a rotational position of the spur gear 215. Thus, the length of the arm 66 is adjustable according to the number of plates P stored in the cassette 9.

In this auto-loader unit 4, as described above, the moving device 200 is driven by the motor 60 to move along the surfaces of the plates P stored in the cassette 9. In time of this movement, the suction pads 67 arranged at the distal end of the arm 66 are swung about the shaft 213 included in the moving device 200.

Next, an operation of the auto-loader unit 4 to transport a plate P will be described. FIGS. 9 through 14B are schematic views showing an operation of the auto-loader unit 4 to feed a relatively small plate P. The mobile member 63 is omitted also from FIGS. 9 through 14B. The plates P stored in the cassette 9 are omitted from FIGS. 9 through 13.

Figure 9:
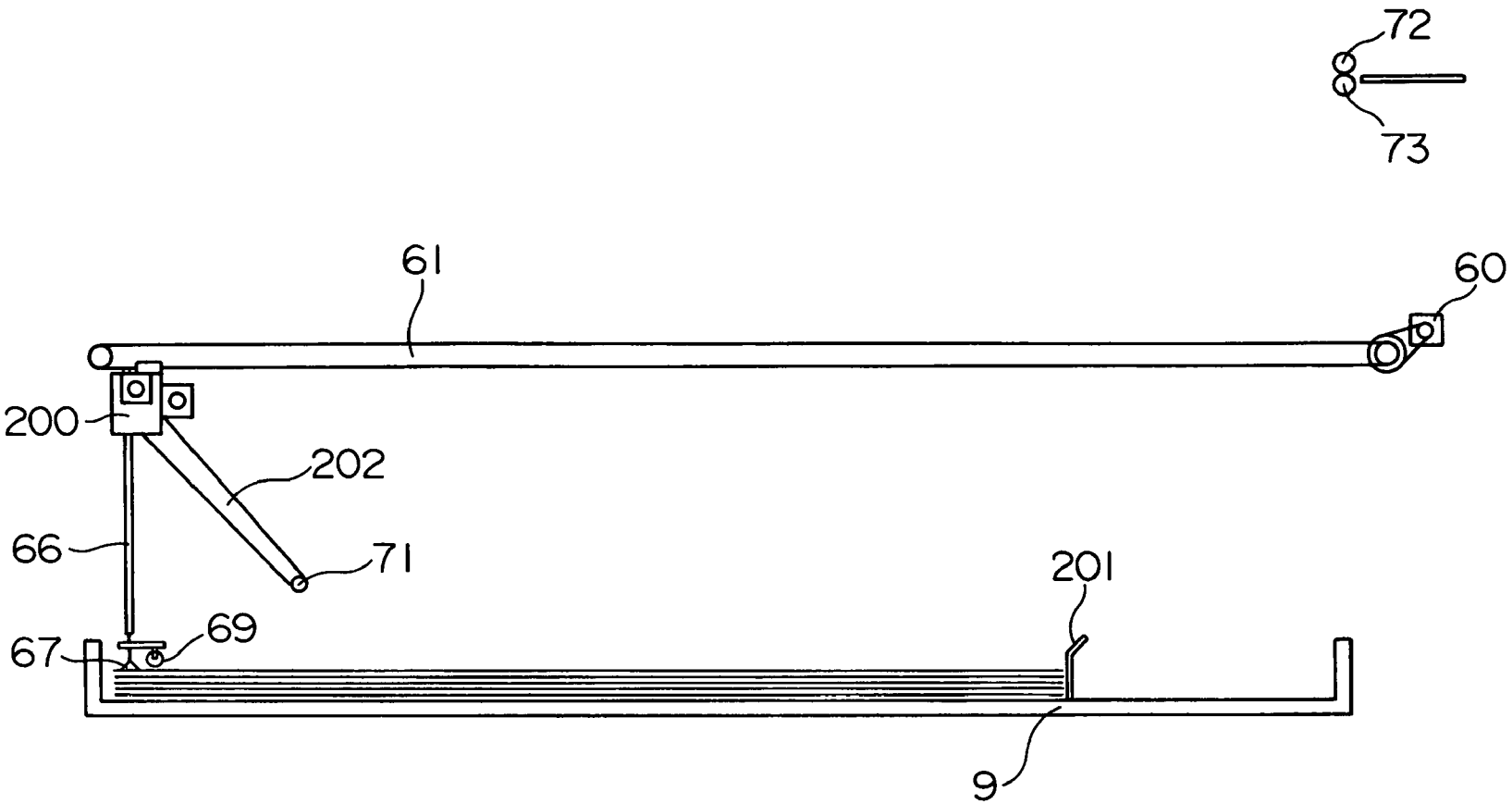
FIG. 9 is a schematic view showing the auto-loader unit in an operation to transport a printing plate.

When starting transportation of a plate P, as shown in FIGS. 5 and 9, the moving device 200 is moved by the motor 60 to move the suction pads 67 adjacent the end of the plate P remote from the nip rollers 72 and 73, and cause the suction pads 67 to suck and hold the upper surface of the plate P. At this time, the plates P stored in the cassette 9 are in a state of having end edges adjacent the nip rollers 72 and 73 made even and positioned by a stopper 201.

Figure 10:
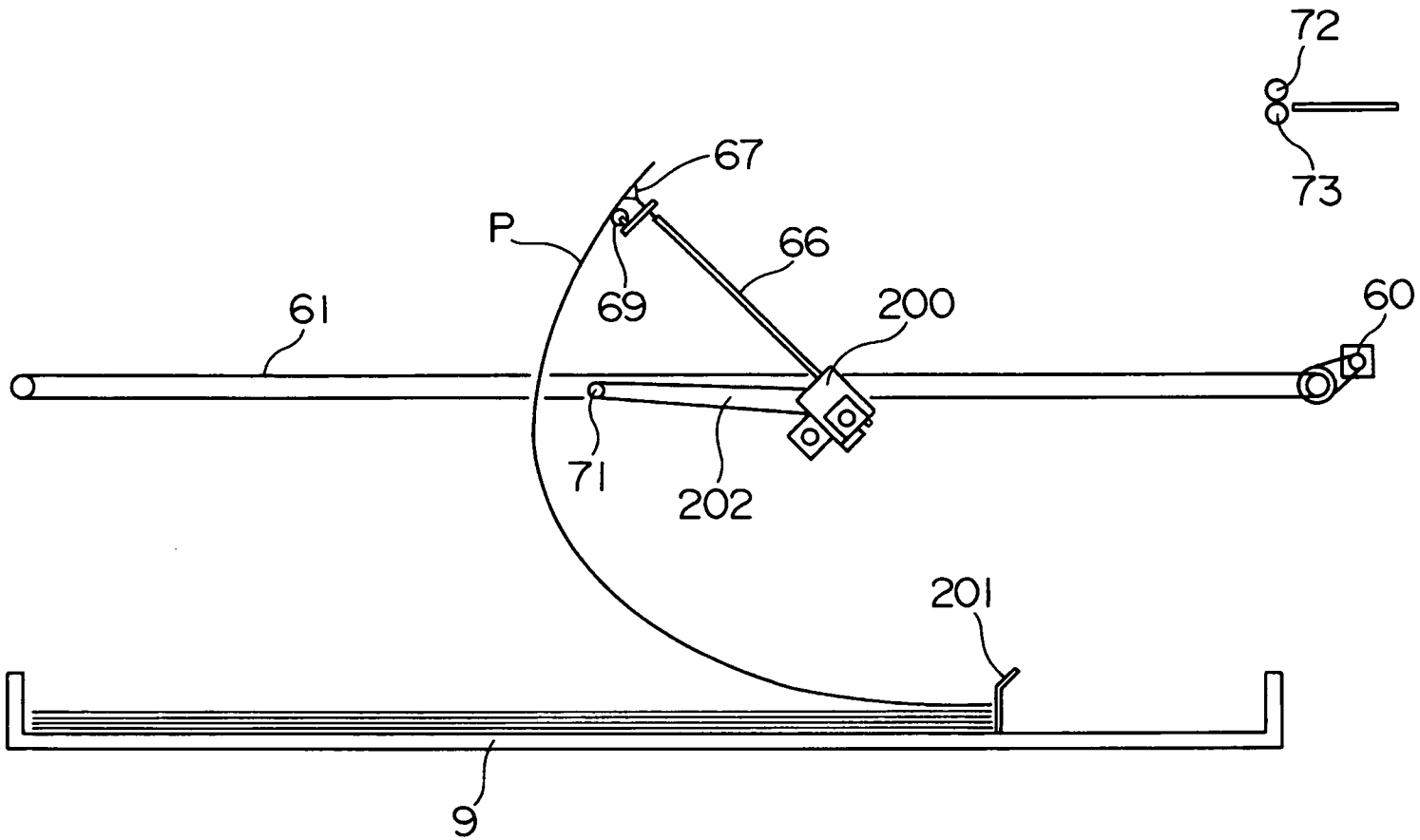
FIG. 10 is a schematic view showing the auto-loader unit in the operation to transport the printing plate.

In this state, the moving device 200 is driven by the motor 60 to move toward the nip rollers 72 and 73. At the same time, the arm 66 is driven by the motor 205 to swing clockwise about the shaft 213. Consequently, the plate P begins to be turned back as shown in FIG. 10.

Figure 11:
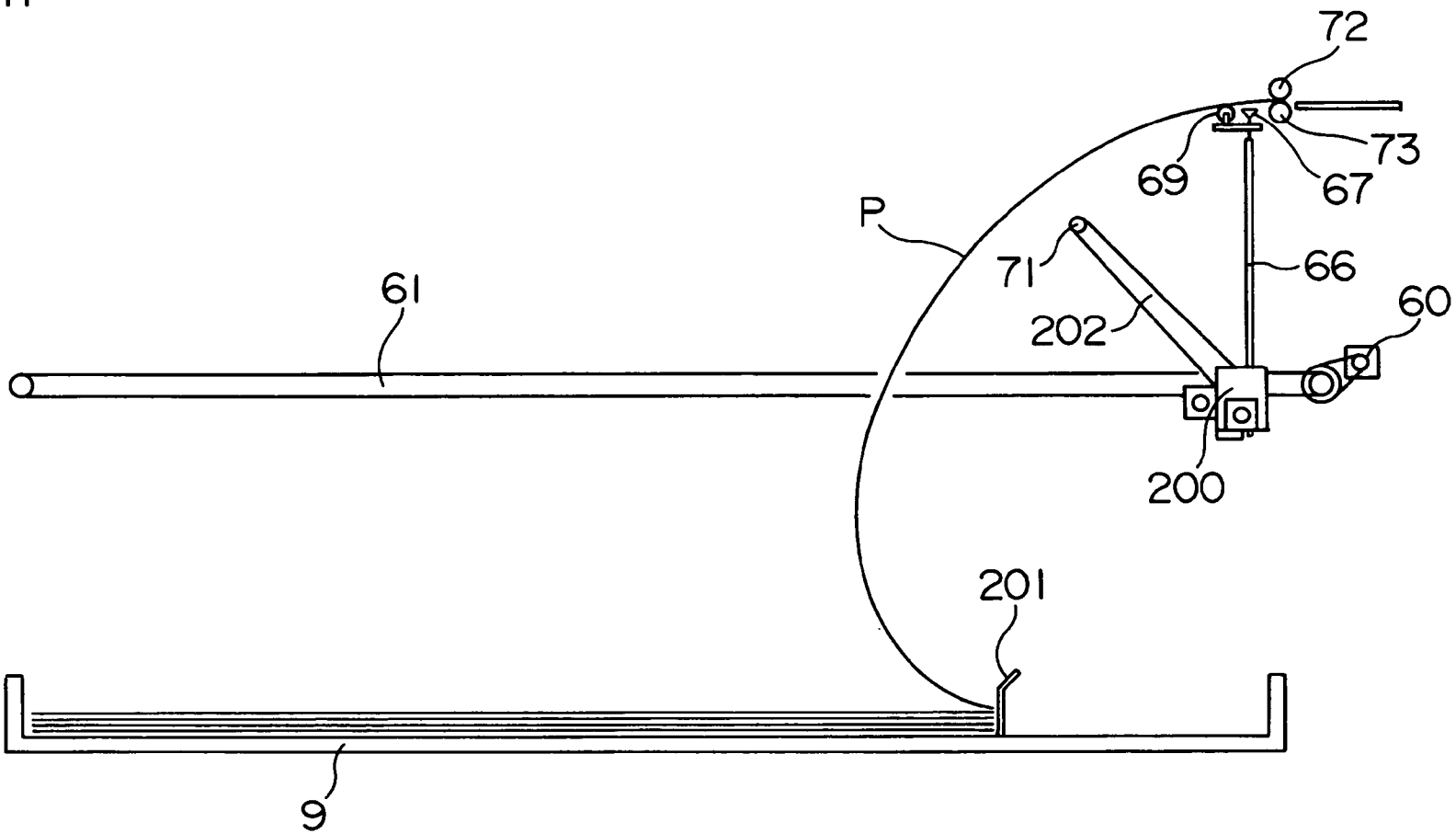
FIG. 11 is a schematic view showing the auto-loader unit in the operation to transport the printing plate.

The movement of the moving device 200 and the swing of the arm 66 are continued, causing the end edge of the plate P to be pinched between the nip rollers 72 and 73 as shown in FIG. 11. Subsequently, the suction holding of the plate P by the suction pads 67 is canceled.

Next, the moving device 200 is driven by the motor 60 to move away from the nip rollers 72 and 73. As a result, the support roller 71 disposed at the distal end of the arm 202 contacts a central region of the plate P. In this state, the moving device 200 is moved further away from the nip rollers 72 and 73. Consequently, as shown in FIG. 12, the support roller 71 presses the central region of the plate P to a position on the side of the stopper 201 remote from the nip rollers 72 and 73.

Figure 12:
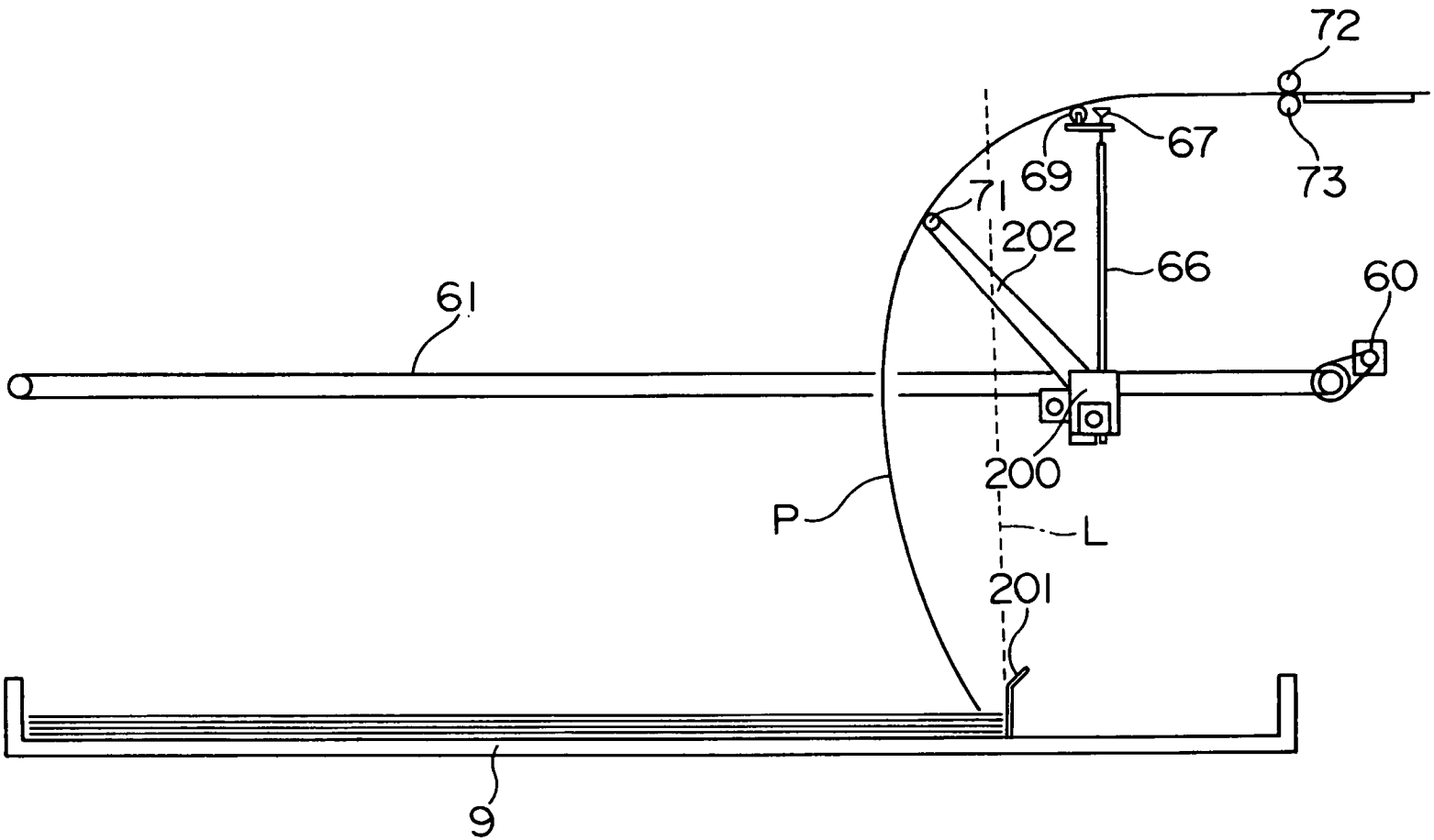
FIG. 12 is a schematic view showing the auto-loader unit in the operation to transport the printing plate.

That is, the moving device 200 is moved leftward, with the angle of the arm 202 maintained, from the position shown in FIG. 11 (with the suction pads 67 lying near the nip rollers 72 and 73) to the position shown in FIG. 12. As a result, the support roller 71 pressing a central region on an inner peripheral surface of a curved portion of the plate P reaches a position on the left side of a vertical line L extending from the stopper 201 (that is, a position on the side of the stopper 201 remote from the nip rollers 72 and 73).

Then, the nip rollers 72 and 73 are rotated to transport the plate P. At this time, as shown in FIG. 12, the plate P is guided by the support rollers 69 and 71.

The following is the reason for causing the support roller 71 to press the central region of the plate P to the position on the side of the stopper 201 remote from the nip rollers 72 and 73.

Figure 14A:
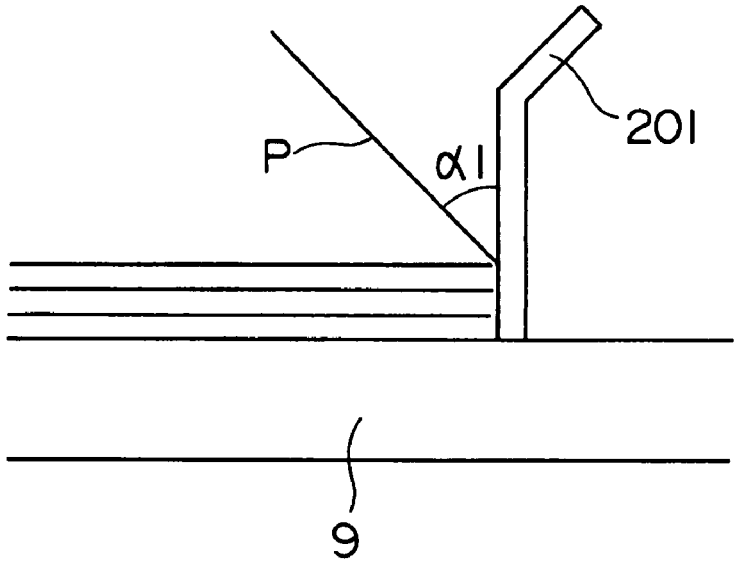
FIG. 14A is a schematic view showing the auto-loader unit in the operation to transport the printing plate.

As the nip rollers 72 and 73 feed the plate P onward, the curved portion of the plate P between the nip rollers 72 and 73 and the stopper 201 gradually becomes short, and its shape gradually changes from curve to straight. However, the above change in shape can be stopped halfway when the plate P, with the central region thereof pressed, is fed by the nip rollers 72 and 73. It is therefore possible, as shown in FIGS. 12 and 14A, to raise the uppermost plate P at a predetermined angle $\alpha 1$ to the rest of the plates P stored.

Figure 13:
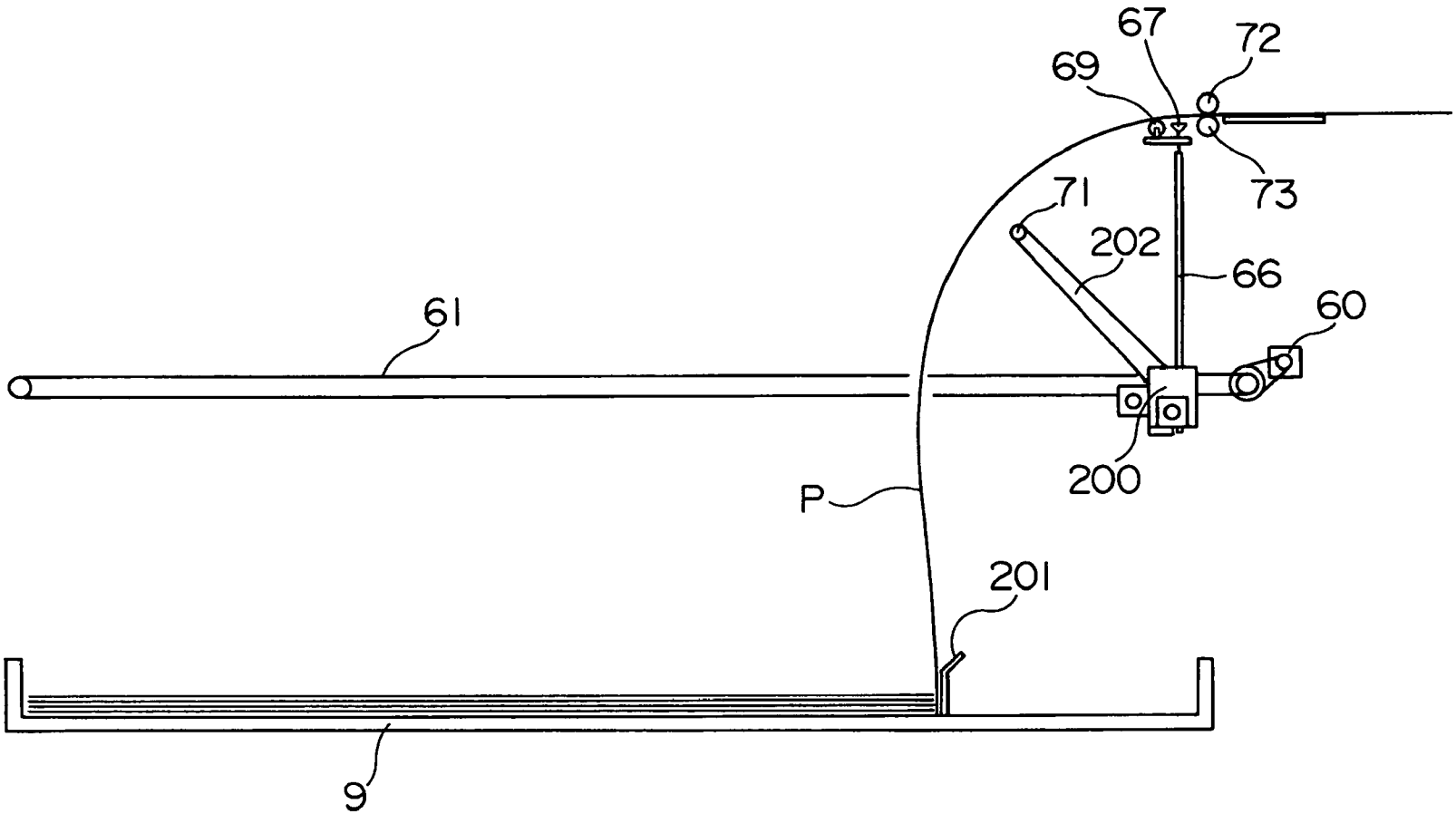
FIG. 13 is a schematic view showing the auto-loader unit in the operation to transport the printing plate.
Figure 14B:
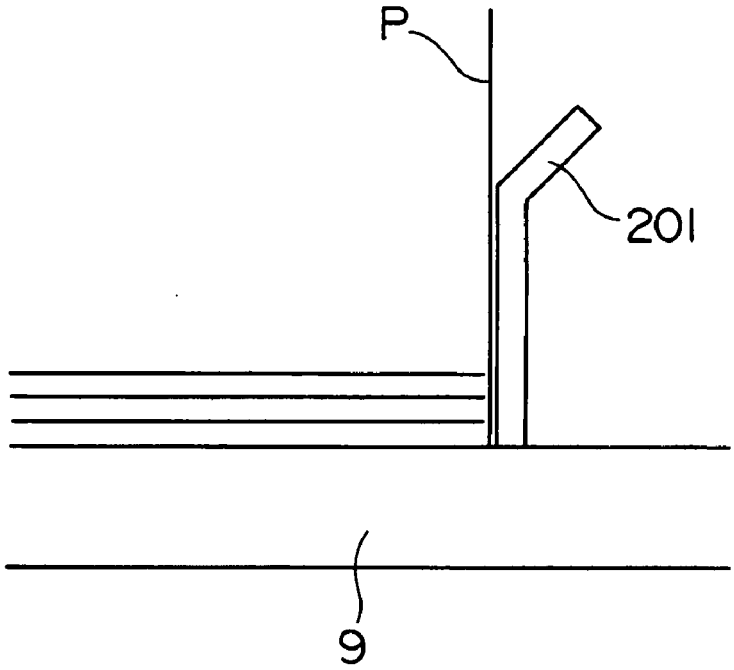
FIG. 14B is a schematic view showing the auto-loader unit in the operation to transport the printing plate.

On the other hand, when the plate P, without being pressed, is transported by the nip rollers 72 and 73, as shown in FIGS. 13 and 14B, the end of the plate P adjacent the stopper 201 will take a vertical position. There occurs a phenomenon, as shown in FIG. 14B, of the end of the plate P adjacent the stopper 201 thrusting itself in between the end edges of the stacked plates P and the stopper 201. Such a phenomenon causes a problem that the plate P cannot be transported properly. Such a phenomenon tends to occur where the distance from the stack of plates P to the nip rollers 72 and 73 is small for the size of plates P.

Therefore, this auto-loader unit 4 is constructed such that, when a plate P is transported by the nip rollers 72 and 73, the support roller 71 presses the central region of the plate P to a position on the side of the stopper 201 remote from the nip rollers 72 and 73.

In the embodiment described above, both of the arm 202 with the support roller 71 acting as the pressing member and the arm 66 with the suction pads 67 are provided for the common moving device 200. It is therefore impossible for the pressing member to make horizontal movement independently of operation of the suction pads 67. The pressing member needs to start pressing the plate P after the suction pads 67 release the plate P.

However, where the pressing member and suction pads 67 can be moved horizontally and separately from each other, it is not necessary to start moving the pressing member horizontally after the nip rollers 72 and 73 pinch the forward end of the plate P. That is, it is possible to start moving the pressing member horizontally while the plate P is being turned back, before the forward end of the plate P is pinched by the nip rollers 72 and 73.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2006-155591 filed in the Japanese Patent Office on Jun. 5, 2006, the entire disclosure of which is incorporated herein by reference.

What is claimed is:

1. A plate feeding apparatus for transporting plates loaded therein, in order from an uppermost plate, while inverting the plates, toward a plate takeout unit that holds and takes out the plate, said apparatus comprising:

a storage unit for storing a plurality of plates with end edges aligned by a stopper;

a moving unit movable along surfaces of the plates stored in said storage unit;

a suction unit disposed at a distal end of an arm swingable about said moving unit for sucking and holding an upper surface adjacent an end edge, remote from said plate takeout unit, of each of the plates stored in said storage unit;

a moving mechanism for moving said moving unit along the surfaces of the plates stored in said storage unit, from a position remote from said plate takeout unit toward said plate takeout unit, and for swinging said arm about said moving unit, thereby moving said suction unit to invert a portion adjacent the end edge of each plate sucked and held by said suction unit, and subsequently to reach a position for each plate to be held by said plate takeout unit;

a pressing member for pressing an inner peripheral surface of a curved portion of each plate which has been curved while being inverted, to locate said curved portion further remote from said plate takeout unit than a vertical line extending from said stopper; and a pressing member moving device for moving said pressing member, wherein the plate feeding apparatus is configured to move said pressing member in a direction away from said plate takeout unit, while said plate takeout unit holds each plate and each plate is in contact with the pressing member.

2. A plate feeding apparatus as defined in claim 1, wherein said pressing member is connected to said moving unit to be movable therewith.

3. A plate feeding apparatus as defined in claim 1, wherein said plate takeout unit includes nip rollers, said pressing member pressing each plate from adjacent said nip rollers to a position further remote from said nip rollers than said stopper, after the nip rollers pinch the portion adjacent the end edge of each plate sucked and held by said suction unit.

4. A plate feeding apparatus for transporting plates loaded therein, in order from an uppermost plate, while inverting the plates, to nip rollers, said apparatus comprising:

a storage unit for storing a plurality of plates with end edges aligned by a stopper;

a moving unit movable along surfaces of the plates stored in said storage unit;

a suction unit disposed at a distal end of an arm swingable about said moving unit for sucking and holding an upper surface adjacent an end edge, remote from said nip rollers, of each of the plates stored in said storage unit;

a moving mechanism for moving said moving unit along the surfaces of the plates stored in said storage unit, from a position remote from said nip rollers toward said nip rollers, and for swinging said arm about said moving unit, thereby moving said suction unit to invert a portion adjacent the end edge of each plate sucked and held by said suction unit, and subsequently to reach a position for each plate to be pinched by said nip rollers; and a pressing member for pressing each plate from adjacent said nip rollers to a position further remote from said nip rollers than said stopper, wherein said pressing member is connected to said moving unit to be movable therewith, and the plate feeding apparatus is configured to move said pressing member in a direction away from said nip rollers while the nip rollers pinch each plate and each plate is in contact with the pressing member.

5. A plate feeding method for transporting plates stored in a storage unit with end edges of the plates aligned by a stopper, in order from an uppermost plate, while inverting the plates, to nip rollers, said method comprising:

a suction-holding step for causing a suction unit to suck and hold an upper surface adjacent an end edge, remote from said nip rollers, of each of the plates stored in said storage unit;

a moving step, while swinging said suction unit about a moving unit, for moving said moving unit along the surfaces of the plates stored in said storage unit, from a position remote from said nip rollers toward said nip rollers, thereby inverting a portion adjacent the end edge of each plate sucked and held by said suction unit, and subsequently moving the end edge of each plate to a position to be pinched by said nip rollers;

a pinching step for causing said nip rollers to pinch the end edge of each plate having been inverted;

a releasing step for canceling suction-holding of each plate by said suction unit; and a pressing step for pressing each plate with a pressing member, said pressing member connected to said moving unit to be movable therewith, from adjacent said nip rollers to a position further remote from said nip rollers than said stopper by moving said pressing member in a direction away from said nip rollers while the nip rollers pinch each plate and each plate is in contact with the pressing member.

6. A plate feeding method as defined in claim 5, further comprising a transporting step for rotating said nip rollers to transport each plate after said releasing step.

* * * * *